US007220023B2

(12) United States Patent
Yoon

(10) Patent No.: US 7,220,023 B2
(45) Date of Patent: May 22, 2007

(54) INDIRECT ILLUMINATION SYSTEM USED AS VENTILATION PATH FOR ELEVATOR

(76) Inventor: Il Shik Yoon, 476-35 Gurobondong, Gurogu, Seoul (KR)

( * ) Notice: Subject to any disclaimer, the term of this patent is extended or adjusted under 35 U.S.C. 154(b) by 208 days.

(21) Appl. No.: 10/854,023

(22) Filed: May 25, 2004

(65) Prior Publication Data

US 2004/0262094 A1 Dec. 30, 2004

(30) Foreign Application Priority Data

Jun. 30, 2003 (KR) ..... 20-2003-0020673

(51) Int. Cl.
*F21V 11/02* (2006.01)
*F21V 29/02* (2006.01)

(52) U.S. Cl. ..... 362/290; 362/294; 362/342; 362/345

(58) Field of Classification Search ..... 362/149, 362/151, 290, 342
See application file for complete search history.

(56) References Cited

U.S. PATENT DOCUMENTS 1,922,786 A * 8/1933 Thompson ..... 362/235
2,216,444 A * 10/1940 McCann ..... 362/291
2,280,881 A * 4/1942 Arenberg ..... 362/480
2,305,722 A * 12/1942 Livers ..... 362/225
2,732,484 A * 1/1956 Lipscomb ..... 362/218
2,761,058 A * 8/1956 Lipscomb ..... 362/290
2,887,564 A * 5/1959 Baran ..... 362/149
3,169,710 A * 2/1965 Lipscomb ..... 362/292
6,789,914 B1 * 9/2004 Brown et al. ..... 362/147

* cited by examiner

*Primary Examiner*—Jong Suk Lee
*Assistant Examiner*—Ismael Negron
(74) *Attorney, Agent, or Firm*—Lumen Intellectual Property Services, Inc.

(57) ABSTRACT

An illuminator is disposed in an air path of a ventilation blower disposed above the ceiling of an elevator cage. An illumination shielding device is disposed below the illuminator and also in the air path. The illumination shielding device includes a plurality of spaced apart parallel rectangular plates, where the lower portions of the plates are inclined toward the elevator cage sidewalls. One or more such combinations of illuminator and illumination shielding device can be used in an elevator cage. Preferably, illuminators and illumination shielding devices are disposed at corners of the elevator cage ceiling, in order to maximize elevator cage capacity. A reflective plate can be mounted to the elevator cage ceiling.

2 Claims, 7 Drawing Sheets

PRIOR ART FIG. 1

PRIOR ART FIG. 2

PRIOR ART FIG. 3

INDIRECT ILLUMINATION SYSTEM USED AS VENTILATION PATH FOR ELEVATOR

CROSS REFERENCE TO RELATED APPLICATIONS

This application is related to and claims priority from Korean utility model application No. 2003-0020673 filed Jun. 30, 2003.

FIELD OF THE INVENTION

The present invention relates to illumination systems for elevators.

BACKGROUND OF THE INVENTION

Generally, a system for illuminating the inside of an elevator cage adopts a direct illumination system, an indirect illumination system, and/or a combined system thereof.

FIG. 1 depicts an example of a prior indirect illumination system. In FIG. 1, illuminators 1 such as fluorescent lamps, electric bulbs and the like are mounted on the ceiling of the elevator cage, and a semitransparent shielding plate 3 is disposed under the illuminator. Since blowers 10 are respectively positioned over the upper corners of the elevator cage and the ventilation paths are respectively placed under the blowers 10 in most existing elevators, as shown in the figure, the air from the respective blowers does not flow past the illuminators when entering into the inside of the elevator cage.

Such an indirect illumination system has some advantages in that ventilation is smooth and passenger's dazzling due to light emitted from the illuminators 1 is prevented by the shielding plate 3. Nevertheless, it is necessary to remove and clean the shielding plate 3 periodically because the shielding plate becomes easily dirty due to dust accumulated on it. In addition, the shielding plate should be removed whenever exchanging the illuminators 1. Further, because the shielding plate 3 is mounted under the ceiling of the elevator cage, the height between the ceiling and the floor of the elevator cage becomes lower so that large cargo 5 such as a wardrobe, tall furniture and the like can not be inserted into the elevator cage, thereby causing inconvenience in carrying such cargo 5.

FIG. 2 shows another embodiment of an indirect illumination system. In the system of FIG. 2, the illuminators 1 are mounted above an opaque shielding plate 3, and light emitted from the illuminators is not directed toward a user and is reflected on the ceiling or the sidewalls of the elevator cage in arrows B and C. In this system, problems such as the light dazzling the user, the intensity of illumination being too high, and the ceiling height being too low and so forth are avoided. However, other problems can occur, such as the shielding plate 3 blocking a portion of ventilation outlet 20 to lower the effect of ventilation, and the illumination effect being substantially decreased due to the illumination by only the light reflected on the ceiling and the sidewalls. Similarly to the example of FIG. 1, the problem of dust accumulation on the shielding plate 3 is also not solved.

FIG. 3 is a view showing an example of a direct illumination system. As shown in the figure, the illuminators 1 are mounted under the ceiling of the elevator cage without a shielding plate. In this system, a dazzling effect occurs, since the light emitted from the illuminator is directly directed to a user. Further, the ceiling height of the elevator cage is too low. In addition, the internal temperature of the elevator cage substantially increases because of the electric lamp used.

SUMMARY OF THE INVENTION

The present invention is designed to solve the aforementioned problems, and it is an object of the present invention to provide an illumination system for an elevator which increases the ceiling height of the elevator cage as high as possible to maximize the spatial capability of the internal space of the elevator cage, prevents the light emitted from the illumination lamp from being directly illuminated toward passengers to prevent dazzling phenomenon, and prevents dust from accumulating on the shielding plate.

According to the present invention for achieving the object, there is provided an indirect illumination system as a ventilation path for an elevator cage using light emitted from an illuminator such as a fluorescent lamp, an electric lamp, or the like, including:

- illumination shielding devices mounted under ventilation outlets for guiding the air flow from blowers disposed over the ceiling of an elevator cage toward the internal space of the elevator cage, the illumination shielding device having at least two inclined long rectangular plates arranged in parallel with certain spaces between each other and having lower portions inclined toward the sidewalls of the elevator cage; and
- illuminators disposed between the illumination shielding devices and the ceiling of the elevator cage to be screened by the illumination shielding devices;
- wherein the air flowing from the ventilation outlets sequentially passes through the illuminators and the illumination shielding devices and then is blown toward the internal space of the elevator cage, and the light emitted from the illuminators is directed toward the sidewalls of the elevator cage through the inclined plates of the illumination shielding devices, thereby preventing dust or the like from accumulating on the illumination shielding devices due to the air flow as well as preventing the light from being directly illuminated toward passengers in the elevator cage.

In accordance with the present invention, it is preferable that the illuminators and the illumination shielding devices are disposed at one or more corners of the ceiling of the elevator cage, as opposed to the central portion of the ceiling.

In addition, in the present invention, it is preferable that the indirect illumination system further includes a reflective plate having good reflectivity mounted on the ceiling of the elevator cage.

BRIEF DESCRIPTIONS OF THE DRAWINGS

The above and other features and advantages of the present invention will become more apparent to those of ordinary skill in the art by describing in detail preferred embodiments thereof with reference to the accompanying drawings in which.

DETAILED DESCRIPTION

Hereinafter, preferred embodiments of the present invention will be described in detail with reference to the accompanying drawings.

Figure 1:
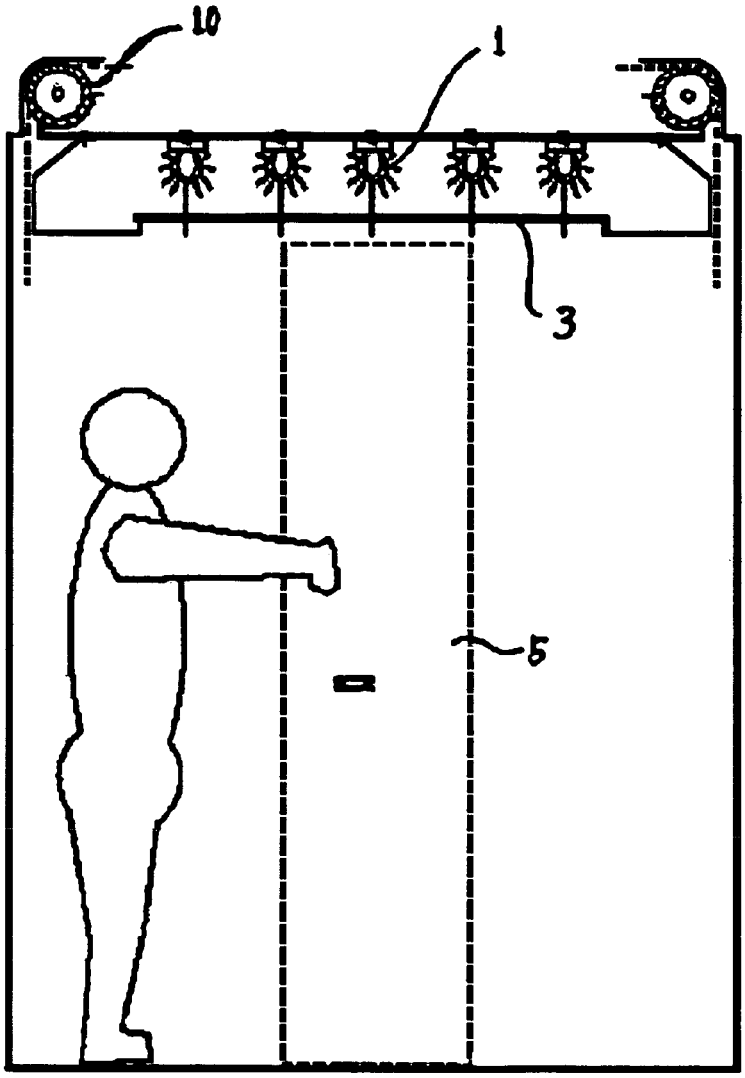
FIG. 1 is a side view showing an example of a prior indirect illumination system for an elevator cage.
Figure 2:
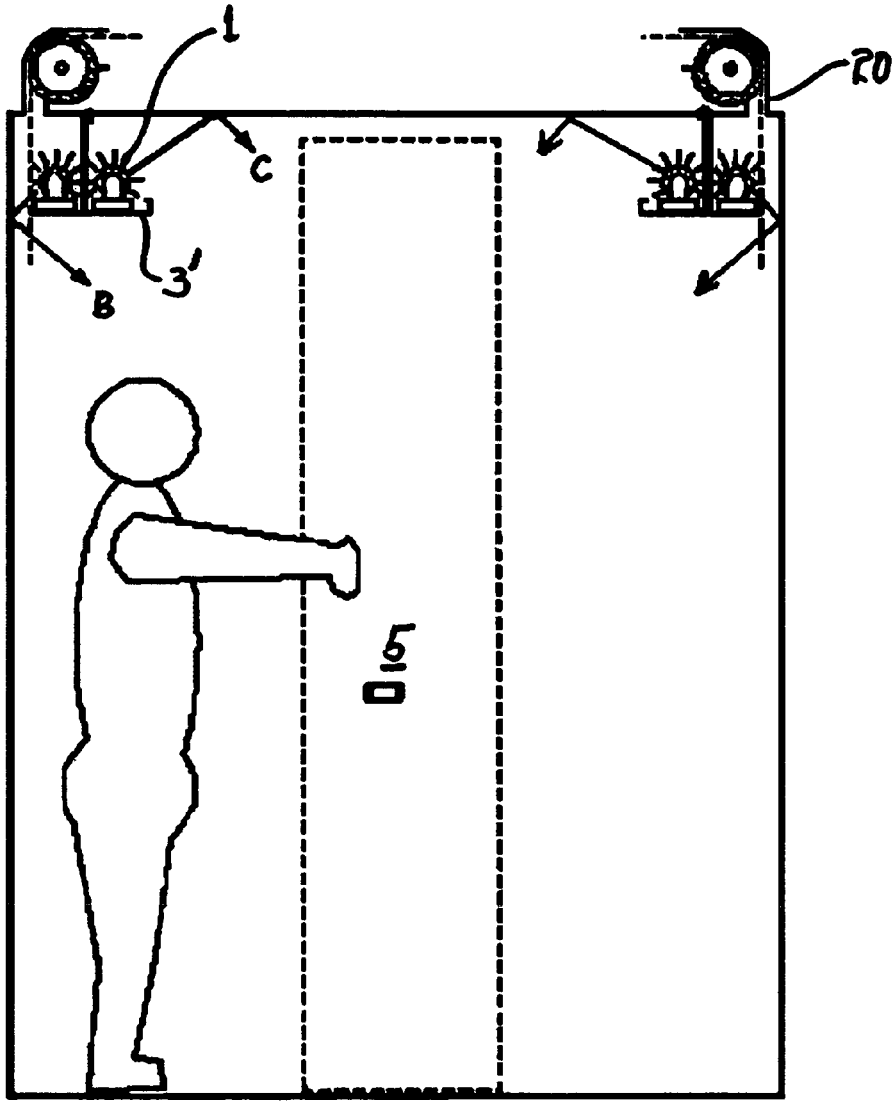
FIG. 2 is a side view showing another prior indirect illumination system for an elevator cage.
Figure 3:
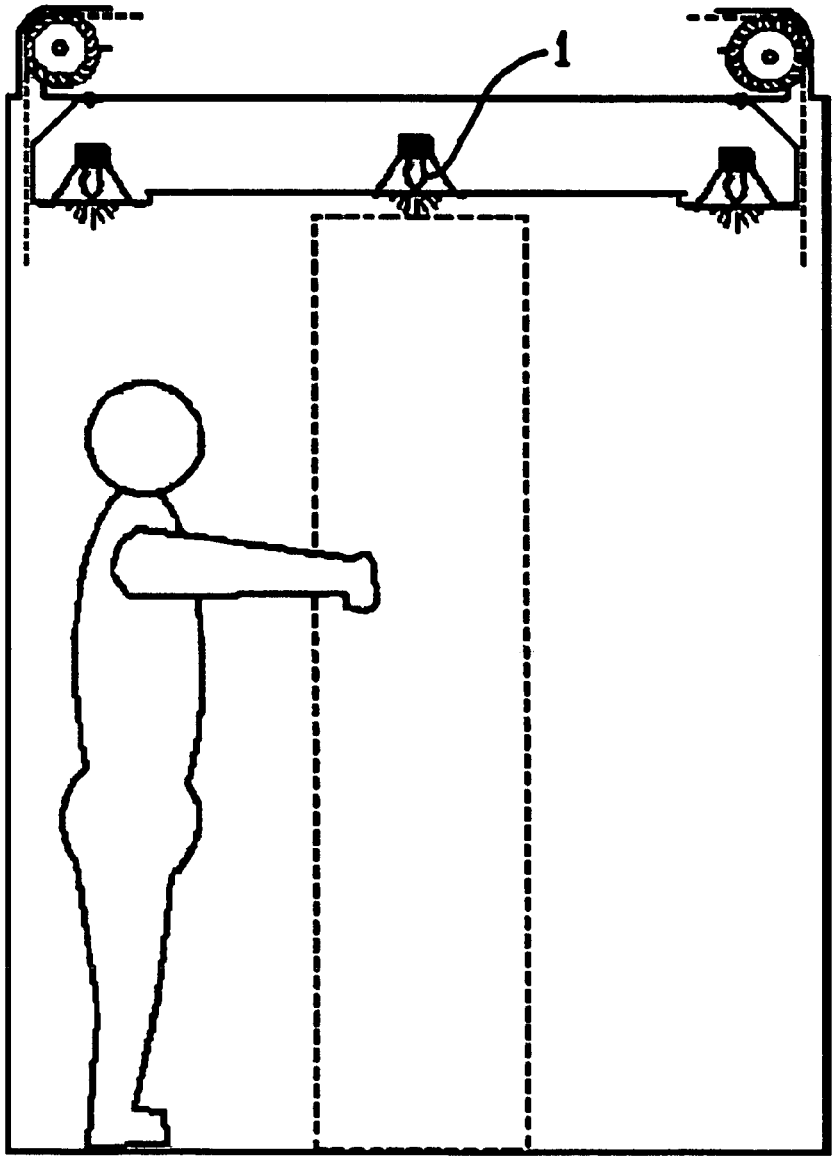
FIG. 3 is a side view showing an example of a prior direct illumination system for an elevator cage.
Figure 4:
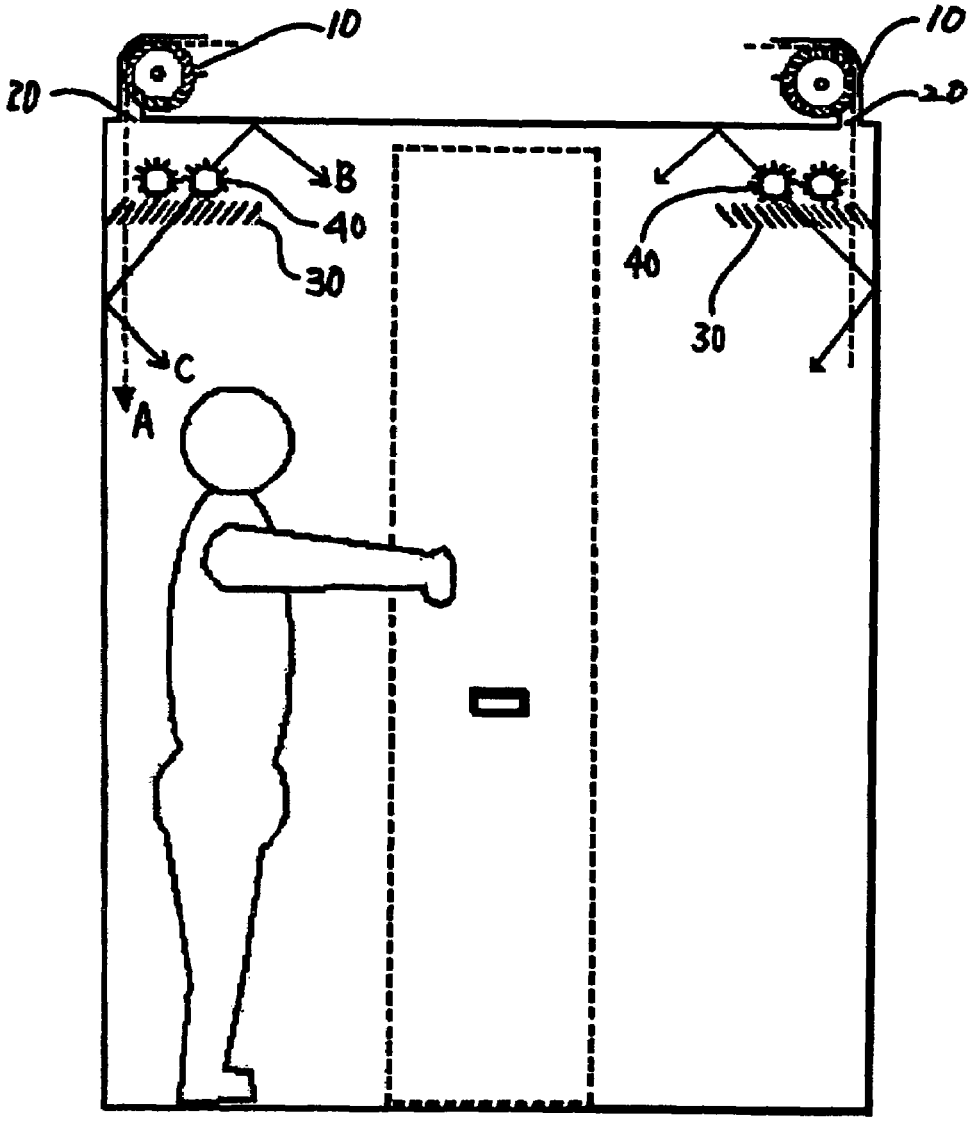
FIG. 4 is a side view showing an indirect illumination system according to the present invention.

FIG. 4 is a side cross-sectional view of an elevator cage in which an illumination system according to the present invention is mounted.

As shown in FIG. 4, blowers 10 are respectively mounted over the respective corner portion of the ceiling of the elevator cage. In the shown example, the blowers 10 are disposed over the left and right upper corners of the elevator cage. The ventilation outlets 20 for guiding the air from the blowers 10 into the inside of the elevator cage are respectively formed under the blowers 10. Illumination shielding devices 30 according to the present invention are respectively disposed under the ventilation outlets 20, and illuminators 40 are disposed above respective illumination-shielding devices 30.

Figure 5:
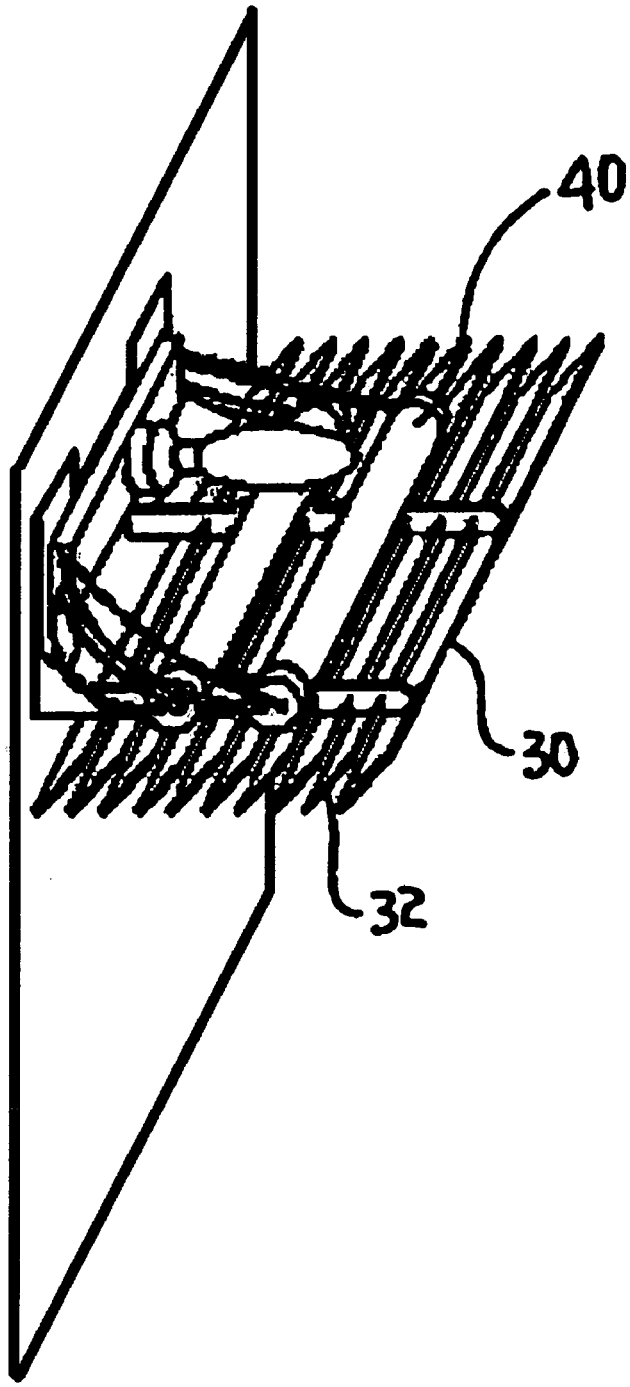
FIG. 5 is a perspective view of an indirect illumination system according to the present invention.
Figure 6:
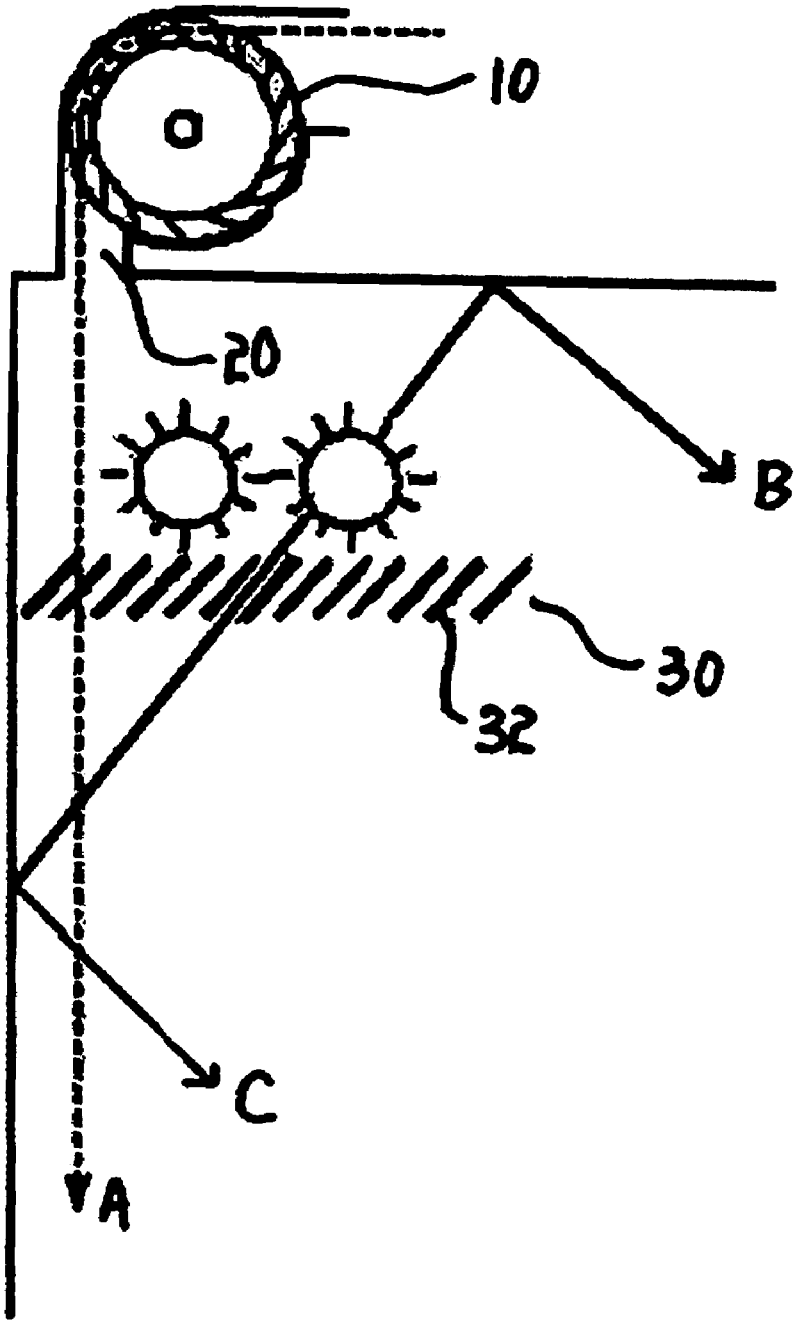
FIG. 6 is a partial side view showing in detail an indirect illumination system according to the present invention.

As shown in FIGS. 5 and 6, the illumination-shielding device 30 comprises a plurality of inclined long rectangular plates 32, each arranged parallel with a certain distance between the plates 32. Plates 32 are inclined toward the sidewall of the elevator cage. Accordingly, the air from the ventilation outlets 20 flows through spaces between the inclined plates 32 into the internal space of the elevator cage along an arrow A denoted by a broken line. In addition, the light emitted from the illuminator 40 is reflected on the ceiling of the elevator cage along an arrow B direction, as well as through the inclined plates 32 on the sidewall of the elevator cage along an arrow C direction. If the inclined plates 32 are inclined in the opposite direction, i.e. the lower portions of the inclined plates are inclined away from the sidewall of the elevator cage, the light emitted from the illuminator is directed toward eyes of a passenger, thereby causing a dazzling phenomenon to the passenger.

The illuminator 40 is arranged between the illumination-shielding device 30 and the ceiling of the elevator cage, and is screened by the illumination-shielding device from the view field of the user.

FIG. 5 is a perspective view showing in detail the illuminator 40 and the shielding device 30, in which both the shielding device 30 and the illuminator 40 are mounted on the sidewall of the elevator cage. In addition, the illuminator 40 can comprise any one of a fluorescent lamp, an electric lamp and a rod shaped bulb and the like as necessary.

FIG. 6 is a side view showing in detail an illumination system according to the present invention. As shown in FIG. 6, the air from the ventilation outlets 20 passes through the spaces between the inclined plates 32 of the shielding devices 30 along an arrow A and then is circulated in the internal space of the elevator cage. In addition, the light emitted from the illuminator 40 is reflected on the ceiling and sidewalls of the elevator cage along arrows B and C.

The air from the ventilation outlet 20 enters into the internal space of the elevator cage by sequentially passing through the illuminator 40 and the illumination shielding device 30 thereby preventing dust and the like from accumulating on the illumination shielding device 30 due to the ventilated air. The light emitted from the illuminator 40 is directed toward the sidewalls of the elevator cage through the spaces between the inclined plates 32 of the illumination shielding device 30, thereby preventing the light from being directly illuminated toward passengers in the elevator cage.

In addition, as shown in FIG. 4, in the illumination system according to the present invention, the illuminators 40 and the illumination shielding devices 30 are mounted on at least one corner of the ceiling of the elevator cage and not in the center portion of the ceiling. Accordingly, the central ceiling height of the elevator cage becomes higher compared with conventional elevator cages, thereby maximizing the spatial capability of the elevator cage.

Figure 7:
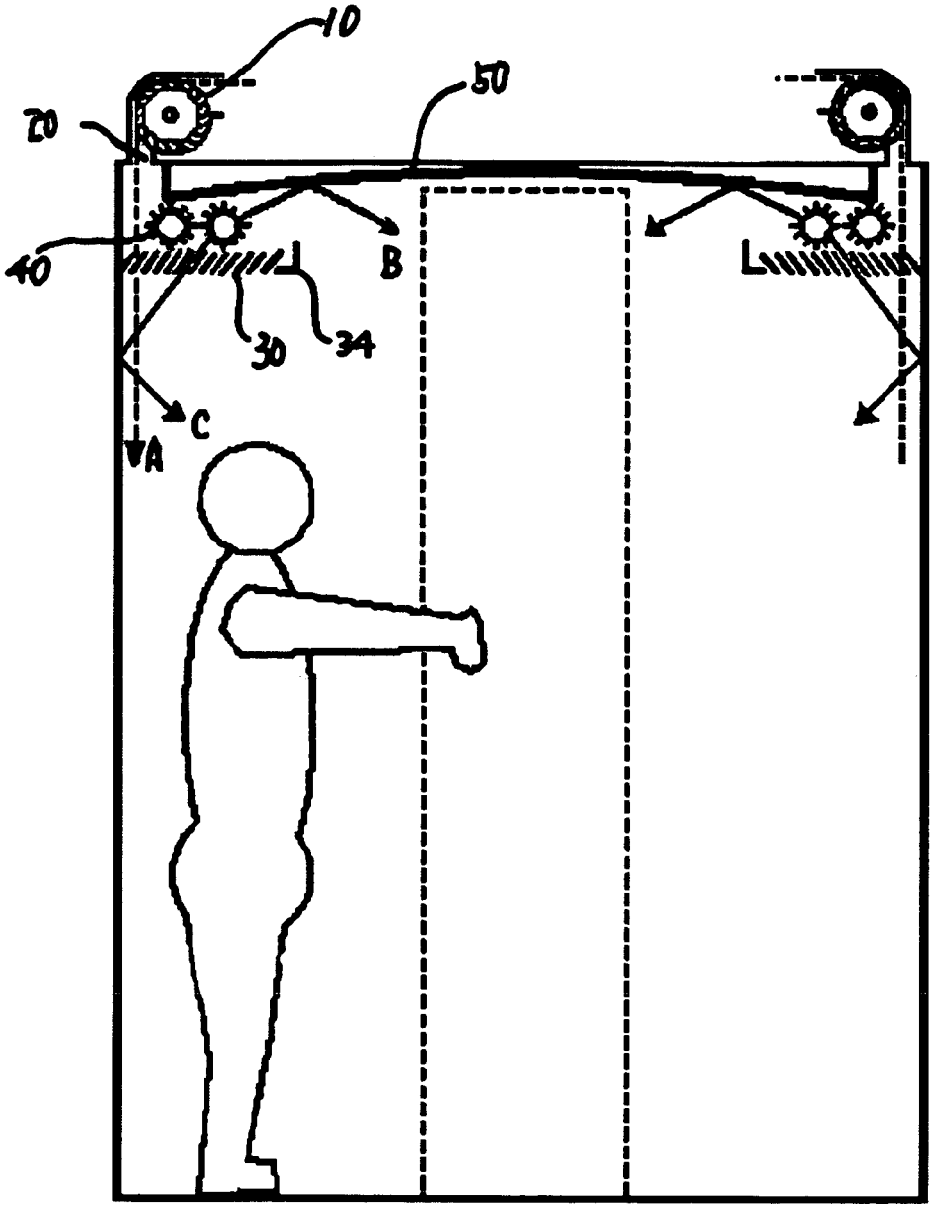
FIG. 7 is a side view showing another example according to the present invention.

FIG. 7 is a side view of another embodiment of the elevator indirect illumination system according to the present invention. This embodiment is similar to the embodiment of FIG. 4 described above except that a reflective plate 50 having high reflectivity is additionally mounted under the ceiling and respective finishing member 34 is fixed to the respective internal end of the shielding device 30. Such a reflective plate 50 completely covers the ceiling of the elevator cage or covers only a central portion of the ceiling as necessary. It is preferable that the reflective plate 50 is mounted to the ceiling of the elevator cage as closely as possible in order to improve the spatial capability of the elevator cage. Accordingly, in this embodiment, the light emitted from the illuminator 40 is reflected on the reflective plate 50 along an arrow B to improve optical efficiency and the L-shaped finishing member 34 is fixed to respective internal end of the shielding device 30 to improve the appearance of the shielding device 30 compared to the embodiment of FIG. 4. This conforms to a recent trend in elevator cage design which places high importance on interior decoration. Therefore, in accordance with the present invention, the internal illumination intensity of the elevator cage is improved and beauty of decoration is enhanced.

According to the illumination system for an elevator constructed as above, the ceiling height of the elevator cage is sufficiently high to maximize the spatial capability of the elevator cage since the shielding plates are disposed only at the upper corners of the ceiling of the elevator cage and not in the central portion of the ceiling. Further, according to the present invention, the reflective effect using the ceiling and sidewalls of the cage is maintained while the light emitted from the illumination lamp is prevented from being directly illuminated toward passengers, thereby providing the necessary intensity of illumination as well as preventing a dazzling phenomenon. In addition, according to the present invention, dust accumulation on the shielding plate can be prevented by air from the ventilation outlet passing through the shielding plate. Further, one side of the shielding plate is open to allow easy exchange of the illumination lamps without removing the shielding plate.

What is claimed is:

1. An elevator illumination and ventilation system, comprising:

(a) an elevator cage;

(b) a mount device mounted inside said elevator cage and located near the ceiling of said elevator cage;

(c) a plurality of light sources mounted to said mounting device;

(d) a blower; and (e) a plurality of plates spaced in parallel and mounted to said mounting device wherein the bottom of each of said plates is slanted towards the closest side wall of said elevator cage, said plurality of plates defining an area whereby said plurality of light sources and said blower are positioned above said defined area of set plates, and wherein the position of said plurality of light sources is approximately centered to said defined area.

2. The elevator illumination and ventilation system of claim 1, further comprising a reflective plate mounted on the ceiling of the elevator cage.

* * * * *